US010045672B2

(12) United States Patent
Eriksson

(10) Patent No.: US 10,045,672 B2
(45) Date of Patent: Aug. 14, 2018

(54) CLEANING ARRANGEMENT FOR A ROTATABLE MEMBER OF A VACUUM CLEANER, CLEANER NOZZLE, VACUUM CLEANER AND CLEANING UNIT

(71) Applicant: Aktiebolaget Electrolux, Stockholm (SE)

(72) Inventor: Henrik Eriksson, Sweden (SE)

(73) Assignee: Aktiebolaget Electrolux (SE)

( * ) Notice: Subject to any disclaimer, the term of this patent is extended or adjusted under 35 U.S.C. 154(b) by 258 days.

(21) Appl. No.: 14/651,059

(22) PCT Filed: Dec. 21, 2012

(86) PCT No.: PCT/EP2012/076620

§ 371 (c)(1),
(2) Date: Jun. 10, 2015

(87) PCT Pub. No.: WO2014/094869

PCT Pub. Date: Jun. 26, 2014

(65) Prior Publication Data

US 2015/0313431 A1 Nov. 5, 2015

(51) Int. Cl.
*A47L 9/04* (2006.01)
*A46B 17/06* (2006.01)

(52) U.S. Cl.
CPC ..... *A47L 9/0477* (2013.01); *A46B 17/06* (2013.01); *A47L 9/0488* (2013.01)

(58) Field of Classification Search
CPC .... A47L 9/0488; A47L 9/0477; A47L 9/0466; A46B 17/06
USPC ..... 15/256.51–256.53
See application file for complete search history.

(56) References Cited

U.S. PATENT DOCUMENTS

| | | | |
|---|---|---|---|
| 804,213 | A | 11/1905 | Chaplin |
| 969,441 | A | 9/1910 | Backer |
| 1,231,077 | A | 6/1917 | Scheffler |
| 1,268,963 | A | 6/1918 | Gray |
| 1,412,420 | A | 4/1922 | Polansky |
| 1,757,461 | A | 5/1930 | Losey |
| 1,813,325 | A | 7/1931 | Smith |
| 1,820,350 | A | 8/1931 | Dance |
| 1,907,692 | A | 5/1933 | White |

(Continued)

FOREIGN PATENT DOCUMENTS

| | | |
|---|---|---|
| CA | 2466000 | 5/2003 |
| CN | 1457742 | 11/2003 |

(Continued)

OTHER PUBLICATIONS

Notice of Allowance dated Jun. 24, 2015 for U.S. Appl. No. 13/826,855.

(Continued)

*Primary Examiner* — Christopher M Koehler
*Assistant Examiner* — Henry Hong
(74) *Attorney, Agent, or Firm* — RatnerPrestia

(57) ABSTRACT

A cleaning arrangement for a rotatable cleaning member of a vacuum cleaner nozzle, the cleaning arrangement being configured and adapted to at least loosen debris entangled to the rotatable cleaning member and comprising a cleaning element configured to selectively engage and disengage the rotatable cleaning member in the course of operating a cleaning process.

17 Claims, 5 Drawing Sheets

(56) References Cited

U.S. PATENT DOCUMENTS 1,965,614 A 7/1934 Sellers
1,999,696 A 4/1935 Kitto
2,032,345 A 3/1936 Cranon
2,625,698 A 1/1953 De Kadt
2,642,601 A 6/1953 Saffioti
2,642,617 A 6/1953 Lilly
2,663,045 A 12/1953 Conway
2,733,000 A 1/1956 Sparklin
2,741,785 A 4/1956 Siebert
2,789,306 A 4/1957 Kath
2,904,818 A 9/1959 Sheahan
2,960,714 A 11/1960 Senne
2,975,450 A 3/1961 Williams
3,268,936 A 8/1966 Fukuba
3,470,575 A * 10/1969 Gordon ..... A46B 17/06 15/188
3,536,977 A 10/1970 Porter
3,683,444 A 8/1972 Schaefer
3,722,018 A 3/1973 Fisher
3,862,467 A 1/1975 Krickovich
3,863,285 A * 2/1975 Hukuba ..... A47L 11/33 15/48
3,928,884 A 12/1975 Sutter
4,020,526 A 5/1977 Johansson
4,084,283 A 4/1978 Rosendall
4,171,554 A 10/1979 Tschudy
4,173,054 A 11/1979 Ando
4,193,710 A 3/1980 Pietrowski
4,209,872 A 7/1980 Maier
4,317,253 A 3/1982 Gut
4,352,221 A 10/1982 Revells
4,370,690 A 1/1983 Baker
4,370,777 A 2/1983 Woerwag
4,372,004 A 2/1983 Vermillion
4,373,228 A 2/1983 Dyson
4,398,231 A 8/1983 Currence
4,426,751 A 1/1984 Nordeen
4,573,235 A 3/1986 Baird, Sr.
4,654,924 A 4/1987 Getz
4,702,122 A 10/1987 Richard
4,802,254 A 2/1989 Lahndorff
4,847,944 A 7/1989 Lackner
4,875,246 A 10/1989 MacGregor
4,920,605 A 5/1990 Takashima
4,953,253 A 9/1990 Fukuda
4,989,293 A 2/1991 Bashyam
5,075,922 A 12/1991 Tsuchida
5,115,538 A 5/1992 Cochran
5,121,592 A 6/1992 Jertson
5,203,047 A 4/1993 Lynn
5,243,732 A 9/1993 Koharagi
5,287,581 A 2/1994 Lo
5,394,588 A 3/1995 Kweon
5,452,490 A 9/1995 Brundula
5,482,562 A 1/1996 Abernathy
5,657,503 A 8/1997 Caruso
5,657,504 A 8/1997 Khoury
5,698,957 A 12/1997 Sowada
5,974,975 A 11/1999 Seefried
6,042,656 A 3/2000 Knutson
6,123,779 A 9/2000 Conrad
6,131,238 A 10/2000 Weber
6,170,119 B1 1/2001 Conrad
6,253,414 B1 7/2001 Bradd
6,266,838 B1 7/2001 Caruso
6,282,749 B1 9/2001 Tajima
6,286,180 B1 9/2001 Kasper
6,289,552 B1 9/2001 McCormick
6,351,872 B1 3/2002 McCormick
6,367,120 B2 4/2002 Beauchamp
6,502,277 B1 1/2003 Petersson
6,539,575 B1 4/2003 Cohen
6,539,577 B1 4/2003 Okuda
6,605,156 B1 8/2003 Clark
6,810,559 B2 11/2004 Mertes
6,883,201 B2 4/2005 Jones
6,892,420 B1 5/2005 Haan
7,143,461 B2 12/2006 Spooner
7,159,276 B2 1/2007 Omoto
7,163,568 B2 1/2007 Sepke
7,171,723 B2 2/2007 Kobayashi
7,228,593 B2 6/2007 Conrad
7,237,298 B2 7/2007 Reindle
7,243,393 B2 7/2007 Matusz
7,293,326 B2 11/2007 Hawkins
7,627,927 B2 12/2009 Blocker
7,631,392 B1 12/2009 Meitz
7,731,618 B2 6/2010 Burlington
8,087,117 B2 1/2012 Kapoor
8,418,303 B2 4/2013 Kapoor
8,567,009 B2 10/2013 Krebs
8,601,643 B2 12/2013 Eriksson
8,671,515 B2 3/2014 Eriksson
9,072,416 B2 7/2015 Kowalski
9,186,030 B2 11/2015 Jung
9,314,140 B2 4/2016 Eriksson
2002/0007528 A1 1/2002 Beauchamp
2004/0172769 A1 9/2004 Giddings
2004/0181888 A1 9/2004 Tawara
2004/0244140 A1 12/2004 Joo
2005/0015916 A1 1/2005 Orubor
2005/0015922 A1 1/2005 Lim
2005/0091788 A1 5/2005 Forsberg
2006/0000053 A1 1/2006 Lim
2006/0037170 A1* 2/2006 Shimizu ..... A47L 9/0477 15/319
2006/0162121 A1 7/2006 Naito
2006/0272122 A1 12/2006 Butler
2006/0288517 A1 12/2006 Oh
2007/0079474 A1 4/2007 Min
2008/0052846 A1 3/2008 Kapoor
2008/0289141 A1 11/2008 Oh
2009/0000057 A1 1/2009 Yoo
2009/0100636 A1 4/2009 Sohn
2009/0229075 A1* 9/2009 Eriksson ..... A46B 13/006 15/383
2010/0107359 A1 5/2010 Yoo
2010/0205768 A1* 8/2010 Oh ..... A47L 9/0416 15/383
2010/0287717 A1* 11/2010 Jang ..... A47L 9/009 15/41.1
2010/0313912 A1 12/2010 Han
2011/0035900 A1 2/2011 Chae
2012/0013907 A1 1/2012 Jung
2012/0124769 A1 5/2012 Krebs
2013/0007982 A1 1/2013 Yun
2013/0008469 A1 1/2013 Yun
2013/0042429 A1* 2/2013 Misumi ..... A46B 13/006 15/415.1
2013/0055522 A1 3/2013 Hawkins
2013/0192021 A1 8/2013 Eriksson
2013/0192022 A1 8/2013 Eriksson
2013/0192023 A1 8/2013 Eriksson
2013/0192024 A1 8/2013 Eriksson
2013/0198995 A1 8/2013 Eriksson
2014/0259521 A1 9/2014 Kowalski
2014/0304941 A1 10/2014 Eriksson
2014/0331446 A1 11/2014 Eriksson
2014/0352104 A1 12/2014 Eriksson
2014/0359968 A1 12/2014 Eriksson
2014/0366300 A1 12/2014 Eriksson
2016/0015233 A1 1/2016 Uphoff

FOREIGN PATENT DOCUMENTS

CN 1593320 3/2005
CN 2746989 12/2005
CN 1816300 8/2006
CN 1816301 9/2006
CN 1883354 12/2006
CN 101310666 11/2008
CN 101686783 3/2010
CN 101984742 3/2011

(56) References Cited

FOREIGN PATENT DOCUMENTS

| | | | |
|---|---|---|---|
| CN | 102334943 | | 2/2012 |
| CN | 102462450 | | 5/2012 |
| DE | 102010017211 | | 12/2011 |
| DE | 102010017258 | | 12/2011 |
| EP | 0649625 | | 9/1994 |
| EP | 1415583 | | 5/2004 |
| EP | 1442693 | | 8/2004 |
| EP | 1642520 | | 4/2006 |
| EP | 1994869 | | 11/2008 |
| EP | 2253258 | | 11/2010 |
| EP | 2273906 | | 1/2011 |
| EP | 2543301 | | 1/2013 |
| FR | 1068296 | | 6/1954 |
| FR | 2855742 | | 12/2004 |
| GB | 2000963 | | 6/1978 |
| GB | 2231778 | | 11/1990 |
| JP | 4944560 | | 4/1974 |
| JP | 05095868 | | 4/1993 |
| JP | 05103740 | | 4/1993 |
| JP | 405095868 | | 4/1993 |
| JP | 405305044 | | 11/1993 |
| JP | 0686743 | | 3/1994 |
| JP | 06086743 | | 3/1994 |
| JP | 0856877 | | 3/1996 |
| JP | 08056877 | | 3/1996 |
| JP | 08289862 | | 11/1996 |
| JP | 11313786 | A | 11/1999 |
| JP | 2002165731 | | 6/2002 |
| JP | 2003047577 | | 2/2003 |
| JP | 2003125991 | | 5/2003 |
| JP | 2003164399 | A | 6/2003 |
| JP | 2004159961 | A | 6/2004 |
| JP | 2005160578 | | 6/2005 |
| JP | 2005211426 | | 8/2005 |
| JP | 2008000382 | | 1/2008 |
| JP | 2008188319 | | 8/2008 |
| JP | 2008278947 | | 11/2008 |
| JP | 2009022644 | A | 2/2009 |
| KR | 20030072414 | A | 9/2003 |
| WO | 9210967 | | 7/1992 |
| WO | 2008099583 | | 8/2008 |
| WO | 2009117383 | | 9/2009 |
| WO | 2010041184 | | 4/2010 |
| WO | 2013060365 | | 5/2013 |
| WO | 2013060879 | | 5/2013 |
| WO | 2013060880 | | 5/2013 |
| WO | 2013113395 | | 8/2013 |
| WO | 2014177216 | | 11/2014 |

OTHER PUBLICATIONS

Office Action dated Jul. 7, 2015 for U.S. Appl. No. 13/826,934.
Office Action dated May 20, 2015 for U.S. Appl. No. 13/835,691.
Entire patent prosecution history of U.S. Appl. No. 14/730,833, filed Jun. 4, 2015, entitled, "Vacuum Cleaner Agitator Cleaner With Agitator Lifting Mechanism."
Chinese Office Action dated Jul. 1, 2015 for Chinese Application No. 201310485330.X, including English language translation.
Chinese Office Action dated Jul. 14, 2015 for Chinese Application No. 201310479507.5, including English language translation.
Chinese Office Action dated Jul. 3, 2015 for Chinese Application No. 201310485943.3, including English language translation.
Chinese Office Action dated Jun. 30, 2015 for Chinese Application No. 201310485447.8, including English language translation.
International Preliminary Report on Patentability for International Application No. PCT/IB2014/001050 dated Sep. 15, 2015.
International Preliminary Report on Patentability for International Application No. PCT/IB2014/001256 dated Sep. 15, 2015.
Notice of Allowance dated Sep. 10, 2015 for U.S. Appl. No. 13/826,630.
Notice of Allowance dated Oct. 9, 2015 for U.S. Appl. No. 14/354,460.
Notice of Allowance dated Oct. 16, 2015 for U.S. Appl. No. 13/835,691.
Notice of Allowance dated Dec. 23, 2015 for U.S. Appl. No. 14/354,460.
Notice of Allowance dated Dec. 31, 2015 for U.S. Appl. No. 13/826,630.
Notice of Allowance dated Dec. 15, 2015 for U.S. Appl. No. 13/835,691.
Final Office Action dated Nov. 30, 2015 for U.S. Appl. No. 13/826,934.
International Search Report dated Dec. 10, 2013 for International Application No. PCT/EP2013/059148.
International Search Report and Written Opinion for International Application No. PCT/IB2015/001873, dated Feb. 4, 2016.
Notice of Allowance dated Feb. 11, 2016 for U.S. Appl. No. 13/826,934.
Japanese Office Action dated Dec. 15, 2015 for Japanese Application No. 2014-555092 with translation.
Chinese Office Action dated Nov. 27, 2015 for Chinese Application No. 201280068532.8 with translation.
Chinese Office Action dated Feb. 29, 2016 for Chinese Application No. 201310485330.X with translation. (pp. 1-9).
Non Final Office Action for U.S. Appl. No. 14/730,833, dated May 19, 2016. (pp. 1-31).
Chinese Office Action dated Apr. 1, 2016 for Chinese Application No. 201280076273.3 with translation. (pp. 1-17).
Chinese Office Action for Chinese Application No. 201310485447.8, dated Feb. 14, 2015 with translation. (pp. 1-5).
Non Final Office Action for U.S. Appl. No. 14/354,449, dated Aug. 11, 2016, 45 pages.
Japanese Office Action for Japanese Application No. 2014-537645, dated Jun. 14, 2016 with translation, 5 pages.
Japanese Office Action for Japanese Application No. 2014-555092, dated May 24, 2016 with translation, 5 pages.
Notice of Allowance for U.S. Appl. No. 14/354,449, dated Nov. 30, 2016, 10 pages.
Non Final Office Action for U.S. Appl. No. 14/888,275, dated Dec. 2, 2016, 24 pages.
Notice of Allowance for U.S. Appl. No. 14/730,833, dated Dec. 2, 2016, 14 pages.
Japanese Office Action for Japanese Application No. 2015548227, dated Oct. 14, 2016, 5 pages.
Chinese Office Action for Application No. 201280058003.X, dated Oct. 9, 2016, 18 pages.
Non Final Office Action for U.S. Appl. No. 14/354,466, dated Jan. 27, 2017, 10 pages.
Non Final Office Action for U.S. Appl. No. 14/467,697, dated Feb. 13, 2017, 17 pages.
Non Final Office Action for U.S. Appl. No. 14/462,956, dated Feb. 22, 2017, 13 pages.
International Preliminary Report on Patentability for International Application No. PCT/IB2015/001873, dated Feb. 28, 2017, 3 pages.
Chinese Office Action for Application No. 201280058003.X, dated Apr. 6, 2017 with translation, 17 pages.
Final Office Action for U.S. Appl. No. 14/354,466, dated May 12, 2017, 13 pages.
Entire patent prosecution history of U.S. Appl. No. 12/405,761, filed Mar. 17, 2009, entitled, "Agitator With Cleaning Features," now U.S. Pat. No. 8,601,643, issued Dec. 10, 2013.
Entire patent prosecution history of U.S. Appl. No. 13/826,400, filed Mar. 14, 2013, entitled, "Brushroll Cleaning Feature With Resilient Linkage to Regulate User-Applied Force," now U.S. Pat. No. 8,671,515, issued Mar. 18, 2014.
Entire patent prosecution history of U.S. Appl. No. 13/826,630, filed Mar. 14, 2013, entitled, "Brushroll Cleaning Feature With Spaced Brushes and Friction Surfaces to Prevent Contact."
Entire patent prosecution history of U.S. Appl. No. 13/826,855, filed Mar. 14, 2013, entitled, "Brushroll Cleaning Feature With Overload Protection During Cleaning."
Entire patent prosecution history of U.S. Appl. No. 13/826,934, filed Mar. 14, 2013, entitled, "Automated Brushroll Cleaning."

(56) References Cited

OTHER PUBLICATIONS

Entire patent prosecution history of U.S. Appl. No. 13/835,691, filed Mar. 15, 2013, entitled, "Vacuum Cleaner Agitator Cleaner With Power Control."
Entire patent prosecution history of U.S. Appl. No. 13/838,035, filed Mar. 15, 2013, entitled, "Vacuum Cleaner Agitator Cleaner With Brushroll Lifting Mechanism."
Entire patent prosecution history of U.S. Appl. No. 14/354,449, filed Apr. 25, 2014, entitled, "Cleaning Nozzle for a Vacuum Cleaner."
Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/354,466, filed Apr. 25, 2014, entitled, "Cleaning Nozzle for a Vacuum Cleaner."
Entire patent prosecution history of U.S. Appl. No. 14/374,119, filed Aug. 25, 2014, entitled, "Cleaning Arrangement for a Nozzle of a Vacuum Cleaner."
Entire patent prosecution history of U.S. Appl. No. 14/462,956, filed Aug. 19, 2014, entitled, "Vacuum Cleaner Brushroll Cleaner Configuration."
Entire patent prosecution history of U.S. Appl. No. 14/467,697, filed Aug. 25, 2014, entitled, "Actuator Mechanism for a Brushroll Cleaner."
International Search Report and Written Opinion for International Application No. PCT/IB2014/001050, dated Oct. 28, 2014.
International Search Report and Written Opinion for International Application No. PCT/IB2014/001256, dated Oct. 28, 2014.
International Search Report for International Application No. PCT/EP2012/076620 dated Jul. 23, 2013.
International Search Report for PCT International Application No. PCT/EP2011/068743 dated Jun. 14, 2012.
International Search Report for PCT International Application No. PCT/EP2012/051773 dated Sep. 17, 2012.
International Search Report for PCT International Application No. PCT/EP2012/071318 dated Jan. 3, 2013.
International Search Report for PCT International Application No. PCT/EP2012/071319 dated Dec. 11, 2012.
Non-Final Office Action dated Apr. 16, 2015 for U.S. Appl. No. 14/354,460.
Notice of Allowance dated Apr. 24, 2015 for U.S. Appl. No. 13/838,035.
Office Action (with English translation)for Chinese Patent Application No. 200980110915.5 dated Feb. 4, 2013.
Search Report and Written Opinion for PCT International Application No. PCT/US2009/037348 dated May 14, 2009.
Supplemental European Search Report for International Application No. EP09721677 dated Oct. 30, 2012.
Entire patent prosecution history of U.S. Appl. No. 14/702,034, filed May 1, 2015, entitled, "Cleaning Nozzle For a Vacuum Cleaner."
Korean Office Action for Korean Application No. 10-2014-7013892, dated Jun. 30, 2017 with translation, 16 pages.
Notice of Allowance for U.S. Appl. No. 14/354,449, dated Augsut 11, 2017, 9 pages.
Notice of Allowance for U.S. Appl. No. 14/354,466, dated Aug. 1, 2017, 8 pages.
Notice of Allowance for U.S. Appl. No. 14/462,956, dated Jul. 19, 2017, 10 pages.
Notice of Allowance for U.S. Appl. No. 14/467,697, dated Jun. 30, 2017, 11 pages.
Non Final Office Action for U.S. Appl. No. 14/374,119, dated Jun. 27, 2017, 8 pages.
Non Final Office Action for U.S. Appl. No. 14/702,034, dated Oct. 16, 2017, 12 pages.
Notice of Allowance for U.S. Appl. No. 14/374,119, dated Feb. 2, 2018, 5 pages.
Notification of Reasons for Refusal for Japanese Application No. 2015-562412, dated Mar. 14, 2018 with translation, 4 pages.
Final Office Action for U.S. Appl. No. 14/702,034, dated Apr. 4, 2018, 7 pages.
Korean Office Action for Korean Application No. 10-2014-7013892, dated Apr. 16, 2018, 12 pages.

* cited by examiner

CLEANING ARRANGEMENT FOR A ROTATABLE MEMBER OF A VACUUM CLEANER, CLEANER NOZZLE, VACUUM CLEANER AND CLEANING UNIT

This application is a U.S. National Phase application of PCT International Application No. PCT/EP2012/076620, filed Dec. 21, 2012, the entire disclosure of which is expressly incorporated by reference herein.

The present invention is directed to cleaning arrangement for a rotatable member of a vacuum cleaner, cleaner nozzle, vacuum cleaner and cleaning unit.

In vacuum cleaners with rotatable or rotating brush-heads, like e.g up-right-, stick-, robotic-, and canister vacuum cleaners, there exists the problem that elongate items, in particular threads, wool fibres, textile fibres, hairs and the like tend to entangle or wrap to the brush-head during operation.

Entangled or wrapped items may greatly impair the functioning and/or cleaning efficiency of the brush-head or respective cleaning nozzle.

A system for removing threads and the like from a brush-head of a vacuum cleaner is known for example from WO 2009/117383 A2. However, there is still room for improvements and alternatives to remove entangled debris from rotating brush-heads of vacuum cleaners.

Therefore, it is an object of the invention to overcome the drawbacks in the state of the art. In particular it is an object to provide possibilities, in particular alternatives, for removing entangled items, in particular threads and other elongated articles, from a brush head of a vacuum cleaner.

This object is solved by the independent claims. Embodiments and variants of the invention result from respective dependent claims.

According to an aspect of the invention, a cleaning arrangement for a rotatable cleaning member of a vacuum cleaner nozzle is provided. The rotatable cleaning member in particular may be a rotatable brush-roll. The rotatable cleaning member, in particular brush roll, as such may comprise one or more lines of bristles or bristle-bundles. The bristles or bristle-bundles may be provided on the cleaning member, in particular a cylindrical drum, in a linear or helical arrangement.

The cleaning arrangement is configured and adapted to at least loosen, in particular disentangle, unwrap and/or unclench, debris entangled to the brush-roll or rotatable cleaning member.

The cleaning arrangement comprises a cleaning element configured to selectively engage and disengage the rotatable cleaning member in the course of operating a cleaning process or cleansing phase intended and adapted for removing debris from the rotatable cleaning member. In particular, the cleaning element is adapted to repeatedly move in and out of engagement with the rotatable member in the course of or during operating the cleaning process in order to loosen, disentangle, unwrap and/or unclench debris entangled to the rotatable member, in particular brush roll.

Selective engagement in particular may require repeatedly or alternatingly engaging and disengaging the rotatable member.

The term selective, however, shall in particular mean, that the cleaning element selectively engages in bristle-free sections and selectively disengages, i.e. is in a disengaged configuration, in bristled sections of the rotatable cleaning member.

Using such a moveable cleaning member, i.e. a cleaning member being moveable between an engaged and disengaged configuration during a cleaning action as proposed beforehand has the advantage that the bristles, in particular bristle bundles, are relieved or released from engagement of the cleaning member during cleaning operations. This may result in lower wear and elongated lifetime of the bristles.

In a further aspect of the invention, a cleaner nozzle configured to be operated with a vacuum cleaner is provided. The cleaner nozzle comprises a cleaning arrangement or is adapted to be coupled to a cleaning arrangement as described above or in any embodiments described further below.

In a yet further aspect of the invention, a vacuum cleaner is provided comprising a cleaner nozzle as described beforehand.

In a further aspect of the invention, a cleaning unit or cleaning station is provided. The cleaning unit or station may be implemented as a device or part separate from the cleaner nozzle and may be adapted to be coupled to or interact with the cleaning nozzle or a rotatable cleaning member of the cleaning nozzle during a cleaning process for removing debris from the cleaning member. During a cleaning process using the cleaning unit or station, the cleaning member is brought into contact or interaction with the cleaning unit such that it interacts with a cleaning arrangement as set out above and in embodiments further below.

In embodiments, the cleaning element is moveably attached to a guiding shaft, running essentially parallel to a longitudinal axis of the rotatable cleaning member. Here, the cleaning element may be moved in axial direction along the guiding shaft in order to locally, i.e. in locations along the longside of the cleaning member, engage or disengage the rotatable cleaning member.

In embodiments, the cleaning element is attached to a guiding shaft. The guiding shaft is running essentially parallel to a longitudinal axis of the rotatable cleaning member.

In embodiments, the attachment to the guiding shaft is such that the cleaning element is moveable in axial direction of the guiding shaft. Along the guiding shaft, the cleaning element may, at any location, be adapted to adopt the disengaged and engaged position. This in particular means that the cleaning element may at any location along the rotatable cleaning member be operated to disentangle, at least loosen, debris adhering or entangled to the rotatable cleaning member.

In embodiments, the cleaning element is moveable along the guiding shaft in at least one of a manual and automatic manner. In particular, the cleaning element may be configured to be manually shifted along the guided shaft in order to successively engage the rotatable cleaning member to at least loosen debris entangled thereon. In other variants, the cleaning element may be configured to be automatically moved along the axial length of the guiding shaft.

In embodiments, the cleaning element is rotatable around the longitudinal axis of the guiding shaft, to at least successively occupy or alter between the engaged and disengaged configuration. This means that the cleaning element may occupy the engaged and disengaged configuration or position in different rotational configurations or positions.

Along the guiding shaft, the cleaning element may, at any location, be adapted to adopt the disengaged and engaged position. This in particular means that the cleaning element may at any location along the rotatable cleaning member be operated to disentangle, at least loosen, debris adhering or entangled to the rotatable cleaning member.

In embodiments, the angle of revolution or rotation between an engaged and disengaged configuration of the cleaning element is one of 90 degrees and 180 degrees. This in particular means that the cleaning element in one case is rotated by 90 degrees to switch from a fully engaged position to a fully disengaged, i.e. released position. And in the other case, the cleaning element is or may be rotated by 180 degrees to be switched from the fully engaged configuration to the fully disengaged configuration.

In embodiments, the cleaning element comprises a cleaning edge configured to interact on entangled debris in at least one of a cutting, frictional and abrasive manner. Such effects have been found to be effective in at least loosening, in particular disentangle, debris wound on the rotatable cleaning member.

In variants, the cleaning edge may be implemented at least partially as a cutting edge. Via a cutting edge, debris entangled to the rotatable cleaning member may be torn in a cutting action, which may be comparatively effective and speed up removal of debris.

In embodiments, the cleaning element comprises a base body to which a single cleaning edge is attached to. In particular in these cases, a rotation of 180 degrees between the engaged and disengaged configuration may apply. It is preferred, that the cleaning edge is provided at a side averted from an axis of rotation of the base body. This may have advantages in quickly moving of transferring the cleaning edge between the engaged and disengaged configuration.

In embodiments, the cleaning element comprises a base body to which at least two cleaning edges are attached to. The cleaning edges preferably are provided at averted sides, in particular longitudinal sides, of the base body. Preferably, the cleaning edges are arranged and provided symmetrically to an axis of rotation of the base body. In particular in these embodiments, rotation between the engaged and disengaged configuration may amount 90 degrees. Here comparatively quick rotation between respective positions may be obtained.

In embodiments, the cleaning element is configured and adapted such that it can be coupled to the cleaning member in such a way that, during a cleaning process, it rotates or can be rotated synchronously with the cleaning member. In particular in these cases, synchronization of rotational movement of the cleaning element and cleaning member can be implemented in such a way that the cleaning or cutting edges exclusively engage brush- or bristle-free sections of the cleaning member. In this way, debris, in particular wool, hair and other entangled matter can be removed without damaging of affecting the brushes or bristles too much.

In other embodiments, the cleaning element is configured to freely rotate around the longitudinal axis of the guiding shaft during a cleaning process. This in particular shall mean that during a cleaning process the cleaning element and cleaning member are free from direct mechanical synchronizing couplings. Rotation of the cleaning element for transferring it to/from the engaged and/or disengaged configuration may for example be obtained via brushes or bristles projecting from the cleaning member and bumping against the cleaning element during rotation such that the cleaning element is rotated relative to the cleaning member. Here, comparatively simple mechanical designs with comparatively high efficiency can be obtained.

In embodiments, the cleaning element and cleaning member are configured such that during the cleaning process the cleaning element repeatedly interacts with a bulge, bead, shred or support section of the cleaning member. The bulge or shred section is implemented in a brush-free or bristle-free section of the cleaning member, in particular the brush-roll. The bulge section in particular may project from a surface of the base body of the cleaning member, wherein the projecting length preferably is less than the projecting length of the brushes or bristles. The bulge section may, in parallel to the bristles or brushes, run along the surface of the base body of the cleaning member in a helical line.

In embodiments, the cleaning element is made from a metal material, and the base body of the cleaning element is made from a plastic material. It shall be noted, that the cleaning element as such may be made as a whole from a metal or plastic material.

From the above description it can be seen, that the proposed cleaning arrangement in particular is suitable for efficiently removing entangled debris from brush-heads of vacuum cleaners.

Embodiments of the invention will now be described in connection with the annexed figures. Note that the exemplary embodiments in the figures will be described to the extent required for understanding the invention. In the figures.

In the figures like and/or functional similar elements will be designated by like reference signs.

Figure 1:
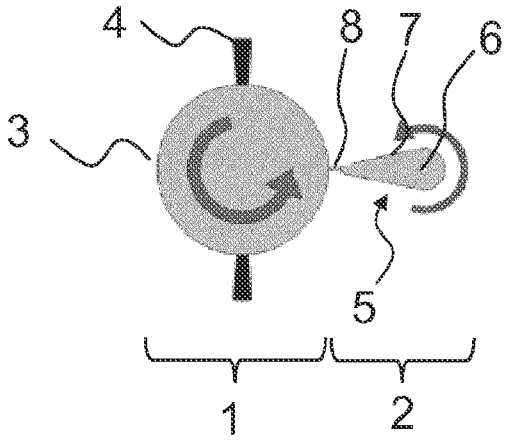
FIG. 1 shows a cross sectional view of a first embodiment of a brush-roll and cleaning arrangement in a first operating state.

FIG. 1 shows a cross sectional view of a first embodiment of a brush-roll 1 and a cleaning arrangement 2 in a first operating state. The brush-roll 1 may be part of a conventional rotating type brush-roll vacuum cleaner, in which a cleaning nozzle is equipped with the rotating type brush-roll 1.

The brush-roll 1 comprises a cylindrical or tubular main body 3. Brushes or bristle bundles 4, intended for raising and collecting dust project from the main body 3 in radial direction. As can be seen in particular in FIG. 3, the bristle bundles 4 may be provided in or more helical lines along the outer surface of the main body 3.

The cleaning arrangement 2 comprises a cleaning element 5. The cleaning element 5 is configured to be rotatable around a shaft 6 running essentially parallel to the longitudinal axis of the main body 3. A possible rotating movement of the cleaning element 5 is indicated by a curved arrow. The same applies to the brush roll 1.

The cleaning element 5 comprises a base body 7, which has an essentially drop-shaped geometry. At the broad-side of the base body 7, the shaft 6 passes through the base body 7. At the narrow-side of the base body 7, a cleaning edge 8 is provided, which in particular may be implemented as a cutting edge.

In the configuration as shown in FIG. 1, i.e. the first operating state, the cleaning element 5 engages, in particular is swung into or transferred to, a cleaning position. In the cleaning position, which is obtained by rotating the cleaning element 5 as indicated by the curved arrow, the cleaning edge 8 is so close, or close enough, to the outer surface of the main body 3 that the cleaning edge 8 can impinge and/or act on debris (not shown) entangled on or at the brush-roll 1.

Debris may for example comprise threads, wool fibres, textile fibres, hairs and the like, as already mentioned above. In impinging the debris in a cutting and/or abrasive manner, the cleaning element 5 can at least loosen or even remove the debris from the brush-roll 1. Loosened debris can withdrawn by a sucking air stream generated by a vacuum cleaner nozzle to which the brush-roll 1 is mounted to.

Figure 2:
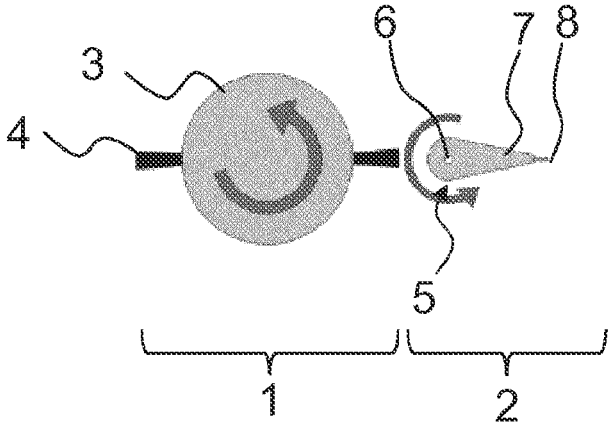
FIG. 2 shows a cross sectional view of the first embodiment brush-roll and cleaning arrangement in a second operating state.

During the cleaning process, the brush-roll 1 is rotated as indicated by the curved arrow in FIG. 1 and FIG. 2, so that the brush-roll 1 and its outer surface can be cleaned all around.

In the configuration shown in FIG. 2, i.e. the second operating state, the cleaning element 5 no longer engages the cleaning position, but rather is transferred to the disengaged configuration in which the cleaning edge 8 is withdrawn or removed from the main body 3, in particular removed from the outer surface of the main body 3.

Moving the cleaning element 5, in particular cleaning edge 8 to the disengaged configuration has the advantage that the bristle bundles 4 rotating with the main body 3 during the cleaning process can pass by the cleaning arrangement without the bristle-bundles 4 being affected or impaired by the cleaning element 5, in particular cleaning edge 8.

As is depicted in FIG. 2, in the event that the bristle bundle 4 passes the cleaning arrangement 2, the cleaning element 5 is in a rotational position in which the cleaning edge 8 is off, i.e. averted from, the brush-roll 1. Hence, no interaction of the bristle bundles 4 with the cleaning edge 8 will occur.

Figure 3:
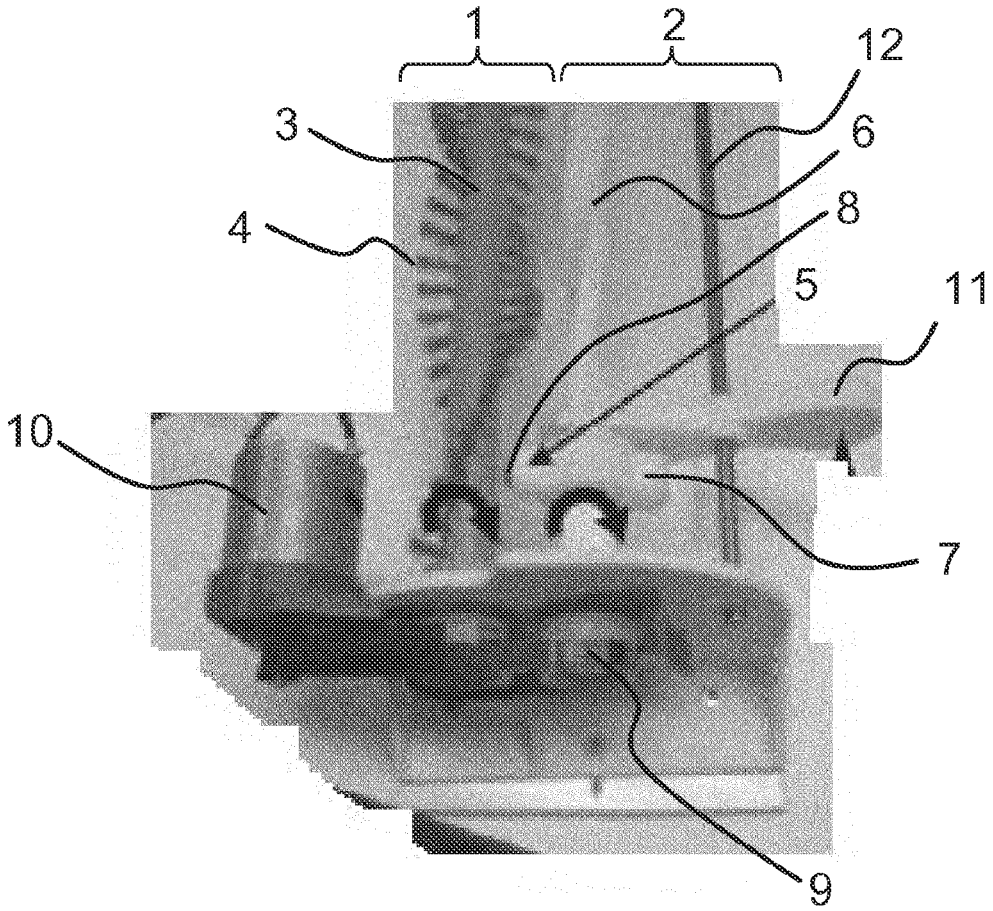
FIG. 3 shows a perspective view of the first embodiment brush-roll and cleaning arrangement.

FIG. 3 shows a perspective view of the brush-roll 1 and cleaning arrangement 2 as described in connection with FIG. 1 and FIG. 2. The position of the cleaning element 5 in FIG. 3 corresponds to that of FIG. 1, where the cleaning element is in the engaged configuration, i.e. engages the brush-roll 1 for loosening or removing debris therefrom.

As will become clear from FIG. 3, the brush-roll 1 and the shaft 6 to or at which the cleaning element 5 is attached to are mechanically coupled, in the present implementation, with a belt 9. The belt 9 presently engages corresponding pulleys provided at axial ends of the brush-roll 1 and shaft 6, respectively. The mechanical coupling between the shaft 6 and brush-roll 1 has the effect, that the cleaning element 5 rotates together and synchronous with the brush-roll 1 during a cleaning phase in which the brush-roll 1 is rotated, i.e. driven, by a drive motor 10. Just for sake of completeness it shall be mentioned that the drive motor 10 is coupled via a further belt to the pulley of the brush-roll 1. Rotation of the brush-roll 1 and shaft 6 is indicated in FIG. 3 by respective curved arrows.

The shaft 6 and cleaning element 5 are designed in such a way that during a cleaning process, forced and synchronized rotation of the cleaning element 5 is obtained. This forced and synchronized rotation is implemented such that the cleaning element 5 engages the brush-roll 1 in bristle-bundle-free sections and disengages the brush-roll 1 in sections where bristle-bundles 4 are provided. With respect to forced and synchronized rotation, further reference is made to the description above.

In FIG. 3, there is further provided a manual slider 11 which is coupled to the cleaning element 5 such that the cleaning element 5 is rotatable relative to the manual slider 11. Further, the manual slider 11 is coupled to a guiding rod 12 running parallel to the shaft 6 and main body 3. The manual slider 11 and guiding rod 12 are coupled and configured in such a way that manual movement of the manual slider 11 along the guiding rod 12 will cause the cleaning member 5 to move along the shaft 6. In this way, the brush-roll 1, in particular main body 3 over essentially the whole axial length can be cleaned or exempted from debris.

In moving the cleaning element 5 along the brush-roll 1 in axial direction of the guiding rod 12, the cleaning element 5 continuously engages and disengages the brush-rod 1 for removing, at least loosen, debris. The continuous engagement/disengagement is such that in bristle-bundle-free regions, the cleaning element 5 is engaged, i.e. is near or at the main body 3 for removing debris. In contrast thereto, the cleaning element 5, in particular the cleaning edge 8, disengages in regions where bristle bundles 4 are provided, i.e. the cleaning edge 8 is off the brush-roll 1 or main body 3.

Instead of providing a manual slider 11 it is also possible to provide an actuator for automatically moving the cleaning element 5 in axial direction of the guiding rod 12.

To summarize, during a cleaning operational phase, both the brush-roll 1 and cleaning element 5 are rotated such that the cleaning element 5, in particular cleaning edge 8, alternatingly engages in bristle-bundle-free sections and disengages the brush-roll 1 in sections with bristle bundles 4. In this way and by manual movement of the cleaning element along the longside of the brush-roll 1, the brush-roll 1 can be freed or exempted from debris entangled at or to the brush-roll 1.

Figure 4:
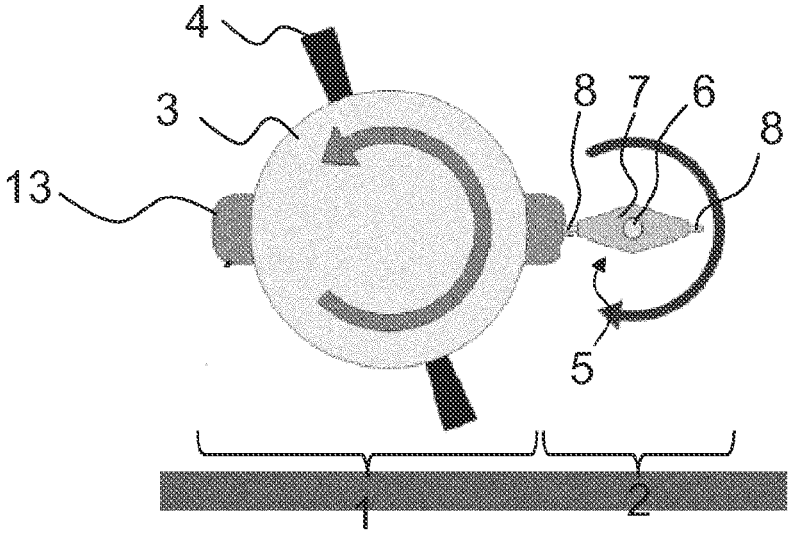
FIG. 4 shows a cross sectional view of a second embodiment of a brush-roll and cleaning arrangement in a first operating state.

FIG. 4 shows a cross sectional view of a second embodiment of a brush-roll 1 and cleaning arrangement 2 in a first operating state. In contrast to the first embodiment shown and described in connection with FIG. 1 to FIG. 3, the cleaning element 5 in the present case comprises two cleaning edges 8 provided at averted axial ends of the elongated base body 7 of the cleaning element 5. The shaft 6 around which the cleaning element 6 in the present case can rotate passes through a center axis of the cleaning element 5. The cleaning edges 8 are provided in symmetrical arrangement relative to the shaft 6.

A further difference to the first embodiment in FIG. 1 to FIG. 3 is that the main body 3 comprises a bulge section 13 or shear section projecting from the main body 3 of the brush-roll 1. The bulge section 13 projects from the main body 3 in such a way, that the level of a shear surface 14 at an outer, circumferential side of the bulge section is lower than the level of the outer ends of the bristle-bundles 4.

Further, the cleaning element 5 is positioned relative to the brush-roll 1 such that in one operational configuration, as shown in FIG. 4, the cleaning edge 4 can interact with the shear surface 14 in order to act upon debris entangled to the main body 3 in a cutting and/or abrasive action. By this, debris will be loosened or even completely removed from the brush-roll 1.

As indicated in FIG. 4, the brush-roll 1 and cleaning element 5 are rotating during the cleaning process. In contrast to the first embodiment, the rotations of the cleaning element 5 and brush-roll 1 are not synchronized by mechanical provisions. Instead, the cleaning element 5 can rotate essentially freely relative to the brush-roll 1.

Figure 5:
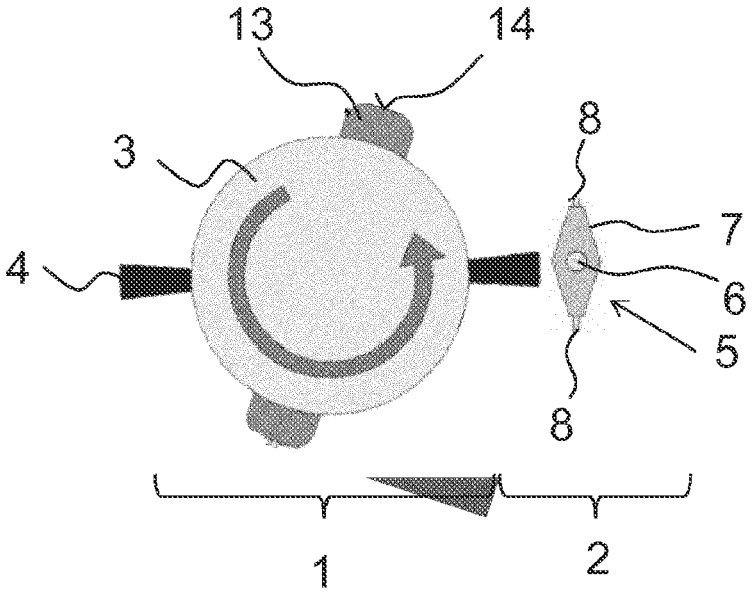
FIG. 5 shows a cross sectional view of the second embodiment brush-roll and cleaning arrangement in a second operating state.

During a cleaning process, if the shear surface 14 or bulge section has passed the cleaning edge 8 of the cleaning element 5 being in the engaged configuration, the bristle bundles 4 will reach the base body 7 of the cleaning element 5. As the outer edges of the bristle bundles 4 radially protrude over the shear surface 14, the outer edges of the bristle bundles 4 will hit the base body 7 and cause the cleaning element 5 to rotate correspondingly. Rotation of the base body 7 will result in disengagement of the cleaning element 5 and cleaning edge 8. In the disengaged configuration as shown in FIG. 5, the cleaning edges 8 are off the brush-roll 1 such that direct contact of the bristle-bundles 4 with the cleaning edge 8 can be prevented.

The momentum transferred to the cleaning element 5 by the bristle-bundles 4 will cause the cleaning element 5 to rotate, in particular such that the other cleaning edge 8 occupies the engaged configuration and can act on debris at the shear surface 14. The cleaning element 5 and shaft 6 may be configured such that after applying a momentum to the base body 7 via the rotating bristle-bundles 4, the cleaning element 5 is transferred from the engaged configuration to an intermediate disengaged section and to the engaged configuration again, such that the cleaning edges alternately interact with or at the shear surface 14.

Similar to the functioning of the first configuration, the cleaning element 5 may be moved along the longside of the brush-roll 1 in order to remove debris over the whole axial length of the brush-roll 1. Movement in axial direction may either be done manually or automatically.

As can be seen, removal or loosening of debris entangled at the brush-roll 1 will or can be obtained in a similar manner as in the first embodiment. It shall be mentioned, that the cleaning element 5 in the second embodiment can be freely rotated with respect to the brush-roll 1, whereas the cleaning element 5 and brush-roll 1 in the first embodiment are fixedly coupled and rotation thereof is synchronous. Using the free rotatable cleaning element 5 may lead to a simpler mechanical construction.

Figure 6:
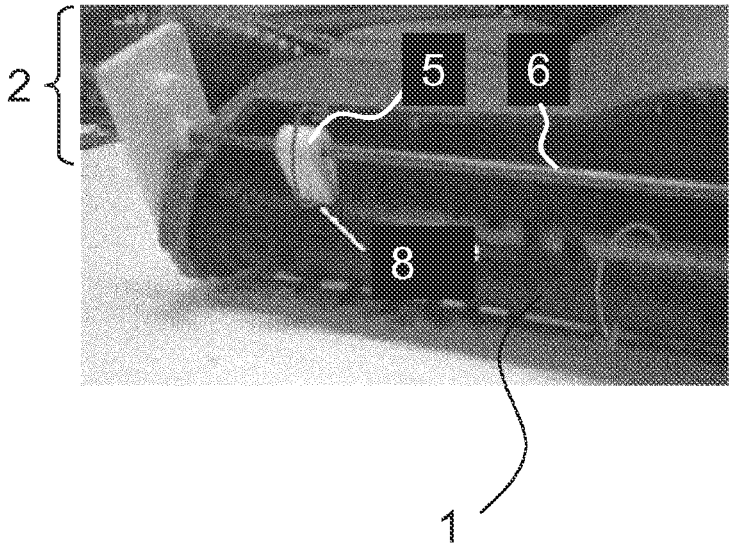
FIG. 6 shows a perspective view of a third embodiment of a brush-roll and cleaning arrangement.

FIG. 6 shows a perspective view of a third embodiment of a brush-roll 1 and cleaning arrangement 2. The brush-roll 1 essentially corresponds to that of the first and second embodiment. The cleaning arrangement 2 is similar to that of the second embodiment, in particular in that the cleaning element 5 is freely rotatable with respect to the brush-roll 1. However, one difference to the second embodiment is that the cleaning element 5 in the third embodiment has only one cleaning edge 8 and that the shape of the base body 7 essentially corresponds to that of the first embodiment, i.e. has a drop-like shape.

Similar to the second embodiment, the bristle-bundles 4 push against the base body 7 of the cleaning element 5 and thereby rotate the cleaning element 5 from the engaged to the disengaged configuration or position. This rotation causes the cleaning edge 8 to move away from the bristle-brushes 4 and then return to the engaged configuration towards the main body 3 of the brush-roll 1 again. Movement of the cleaning element 5 along the longside of the brush-roll 1 may be done in a manual or automatic action.

As can be seen, the cleaning arrangements as described in connection with the first to third embodiments are suitable for removing, at least loosening debris entangled to or at the brush-roll of a vacuum-cleaner nozzle. Removing entangled debris may be carried out in cleaning procedures, that may be activated by a user on the vacuum cleaner and/or nozzle.

Figure 7:
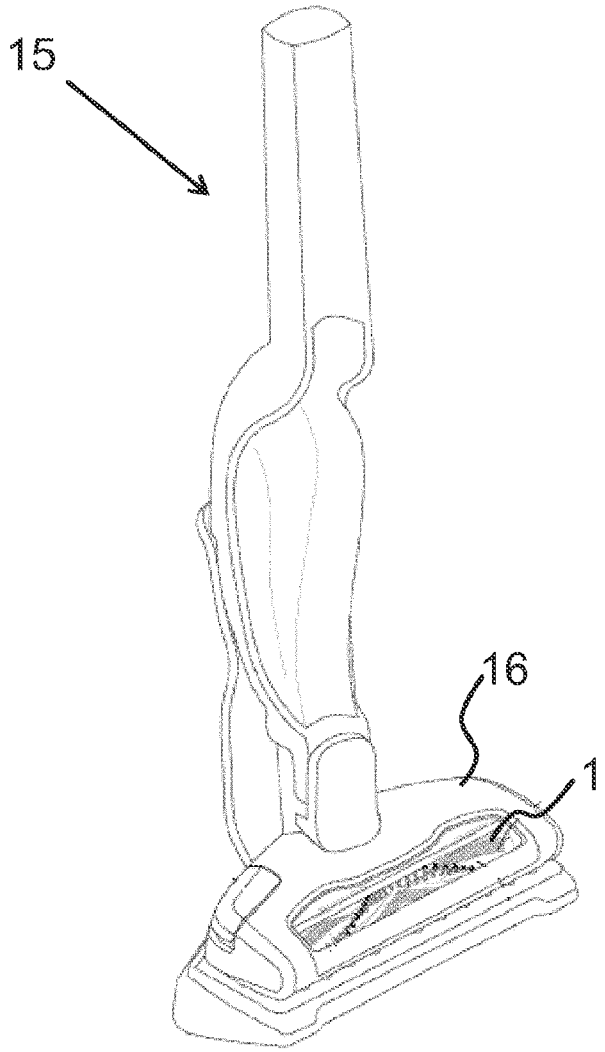
FIG. 7 shows a vacuum cleaner.

FIG. 7 shows a vacuum cleaner comprising a nozzle 16 for picking up dirt and debris during cleaning operations. The nozzle 16 may comprise a brush-roll 1 and a cleaning arrangement (not visible in FIG. 7) according to any of the first to third embodiments described in more detail above and further above.

It shall be noted, that the cleaning arrangement 2 may, as mentioned, be integrated in the nozzle 16 of the vacuum cleaner 15. However, it is also possible that the cleaning arrangement 2 is implemented as a separate tool or device to which the nozzle 16 and brush-roll 1 of a vacuum cleaner can be coupled to for disentangling, loosening and removing debris entangled to the brush-roll 1.

LIST OF REFERENCE NUMERALS

1 brush-roll
2 cleaning arrangement
3 main body
4 bristle bundle
5 cleaning element
6 shaft
7 base body
8 cleaning edge
9 belt
10 drive motor
11 manual slider
12 guiding rod
13 bulge section
14 shear surface
15 vacuum cleaner
16 nozzle

The invention claimed is:

1. A cleaning arrangement for a rotatable cleaning member of a vacuum cleaner nozzle, the cleaning arrangement being configured to at least loosen debris entangled to the rotatable cleaning member and comprising a cleaning element configured to selectively engage and disengage the rotatable cleaning member in the course of operating a cleaning process;

wherein the cleaning element is rotatably mounted adjacent the rotatable cleaning member, and slidably mounted to move in a direction parallel to an axis of rotation of the rotatable cleaning member;

wherein the cleaning element comprises a cleaning edge configured to interact on the debris entangled on the cleaning member in at least one of a cutting, frictional and abrasive action; and wherein the cleaning element is configured to be coupled to the cleaning member such that the cleaning edge can be rotated, synchronously with the cleaning member, though a continuous angle of revolution of 360 degrees during the cleaning process.

2. The cleaning arrangement according to claim 1, wherein the cleaning element is attached to a guiding shaft running essentially parallel to a longitudinal axis of the rotatable cleaning member.

3. The cleaning arrangement according to claim 2, wherein the cleaning element is moveable in an axial direction of the guiding shaft.

4. The cleaning arrangement according to claim 3, wherein the cleaning element is moveable along the guiding shaft in at least one of a manual and automatic movement.

5. The cleaning arrangement according to claim 2, wherein the cleaning element is rotatable around a longitudinal axis of the guiding shaft, to at least successively occupy or alter between the engaged and disengaged configuration.

6. The cleaning arrangement according to claim 5, wherein an angle of revolution between the engaged and disengaged configuration of the cleaning element is one of 90 degrees and 180 degrees.

7. The cleaning arrangement according to claim 2, wherein the cleaning element is configured to freely rotate around a longitudinal axis of the guiding shaft during the cleaning process.

8. The cleaning arrangement according to claim 1, wherein the cleaning edge at least partially comprises a cutting edge.

9. The cleaning arrangement according to claim 1, wherein the cleaning element comprises a base body to which a single cleaning edge is attached.

10. The cleaning arrangement according to claim 9, wherein the cleaning edge is provided at a side averted from an axis of rotation of the base body.

11. The cleaning arrangement according to claim 1, wherein the cleaning element comprises a base body to which at least two cleaning edges are attached.

12. The cleaning arrangement according to claim 11, wherein the cleaning edges are provided at averted sides of the base body and symmetrically to an axis of rotation of the base body.

13. The cleaning arrangement according to claim 1, wherein the cleaning element and cleaning member are configured such that during the cleaning process the cleaning element repeatedly interacts with a bulge section projecting from a brush- or bristle-free section of the cleaning member.

14. The cleaning arrangement according to claim 1, wherein the cleaning edge is made from a metal material, and wherein a base body of the cleaning element is made from a plastic material.

15. A cleaner nozzle configured to be operated with a vacuum cleaner; the cleaner nozzle further comprising the cleaning arrangement according to claim 1.

16. A vacuum cleaner comprising the cleaner nozzle according to claim 15.

17. The cleaning arrangement according to claim 1, wherein the cleaning element is configured to rotate in a same direction as the rotatable cleaning member.

* * * * *